US007631395B2

(12) United States Patent
Oh

(10) Patent No.: US 7,631,395 B2
(45) Date of Patent: Dec. 15, 2009

(54) SUCTION NOZZLE FOR VACUUM CLEANER

(75) Inventor: Jang-keun Oh, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 75 days.

(21) Appl. No.: 11/983,236

(22) Filed: Nov. 8, 2007

(65) Prior Publication Data

US 2008/0301901 A1 Dec. 11, 2008

(30) Foreign Application Priority Data

Jun. 11, 2007 (KR) ..... 10-2007-0056720

(51) Int. Cl.
*A47L 5/00* (2006.01)

(52) U.S. Cl. ..... 15/355; 15/360; 15/364; 15/365; 15/369; 15/398; 15/402; 15/415.1

(58) Field of Classification Search ..... 15/355, 15/360, 364, 365, 369, 393, 398–402, 415.1; *A47L 5/30*
See application file for complete search history.

(56) References Cited

U.S. PATENT DOCUMENTS 2,086,124 A 7/1937 Ell ..... 15/158
3,825,972 A * 7/1974 MacFarland ..... 15/373
4,143,441 A * 3/1979 Brooks et al. ..... 15/369
6,742,220 B2 * 6/2004 Nagai et al. ..... 15/401

FOREIGN PATENT DOCUMENTS

| | | |
|---|---|---|
| GB | 2425715 | 11/2006 |
| JP | 2000-157461 | 6/2000 |
| JP | 2006020895 | 1/2006 |

OTHER PUBLICATIONS

Extended Search Report dated Nov. 25, 2008 corresponding to European Patent Application No. 08005258.2.

* cited by examiner

*Primary Examiner*—David A Redding
(74) *Attorney, Agent, or Firm*—Ohlandt, Greeley, Ruggiero & Perle, L.L.P.

(57) ABSTRACT

The present disclosure relates to a suction nozzle for a vacuum cleaner, which includes a nozzle body having a contaminants suction port formed on a bottom surface thereof, and a fur-removing member having a fur-removing body rotatably disposed at a side of the contaminants suction port on the nozzle body, a fur-removing portion formed in a plurality of pins vertically to the fur-removing body, and a plurality of rotation cams, wherein when the nozzle body moves in a first direction, the plurality of rotation cams forces the fur-removing body to rotate so that a leading end of the fur-removing portion is spaced apart from a surface to be cleaned.

14 Claims, 10 Drawing Sheets

SUCTION NOZZLE FOR VACUUM CLEANER

CROSS-REFERENCE TO RELATED APPLICATIONS

This application claims the benefit under 35 U.S.C. §119 (a) from Korean Patent Application No. 2007-56720 filed Jun. 11, 2007 in the Korean Intellectual Property Office, the disclosure of which is incorporated herein by reference in its entirety.

BACKGROUND OF THE INVENTION

1. Field of the Invention

The present disclosure relates to a vacuum cleaner. More particularly, the present disclosure relates to a suction nozzle for a vacuum cleaner having a fur removing member.

2. Description of the Related Art

Generally, a conventionally-arranged vacuum cleaner has a suction nozzle to draw in contaminants with air from a surface to be cleaned.

The suction nozzle is structured to move on the surface to be cleaned, and has, on a bottom surface thereof, a contaminants suction port to draw in contaminants from the surface to be cleaned. When a vacuum generator in a vacuum cleaner body operates to generate a suction force, contaminants, along with air, are drawn from the surface to be cleaned into the suction nozzle via the contaminants suction port.

However, when cleaning the surface to be cleaned such as a carpet using only the suction force, long thin contaminants such as human hair, or pet fur (hereinafter individually and collectively referred to as "fur") cannot be removed effectively. In order effectively to remove long thin contaminants such as human hair, or pet fur, it is preferable to scrape the long thin contaminants such as human hair, or pet fur, into a lump, and then, guide same toward the contaminants suction port.

Especially when cleaning a carpet, the long thin contaminants such as human hair, or pet fur, are tangled with carpet fibers, and so cannot be separated from the carpet by solely with suction. Therefore, it is required to disentangle from the carpet, as by scraping, the long thin contaminants tangled therein. Disentangled long thin contaminants may then be guided toward the contaminants suction port (i.e. effectively cleaned from the rug).

SUMMARY OF THE INVENTION

The exemplary embodiments of the present disclosure have been developed in order to overcome the above drawbacks and other problems associated with conventionally-arranged vacuum cleaners. An aspect of the present disclosure is to provide a vacuum cleaner suction nozzle that can effectively separate long thin contaminants such as human hair, or pet fur, from a surface to be cleaned, and draw in the separated long thin contaminants.

The above aspect and/or other feature of the present disclosure can substantially be achieved by providing a suction nozzle for a vacuum cleaner that includes a nozzle body having a contaminants suction port formed on a bottom surface thereof, and a fur-removing member having a fur-removing body rotatably disposed at a side of the contaminants suction port on the nozzle body, a fur-removing portion formed in a plurality of pins vertically to the fur-removing body, and a plurality of rotation cams, wherein when the nozzle body moves in a first direction, the plurality of rotation cams forces the fur-removing body to rotate so that a leading end of the fur-removing portion is spaced apart from a surface to be cleaned.

The plurality of rotation cams may be formed substantially in a fan shape, and a side surface of each of the plurality of rotation cams may be disposed on the fur-removing body substantially parallel to the plurality of pins of the fur-removing portion.

A length of each of the rotation cams from a bottom surface of the fur-removing body to a leading end of each of the rotation cams may be longer than a length of the fur-removing portion from the bottom surface of the fur-removing body to a leading end of the fur-removing portion.

The fur-removing portion may include a plurality of pins formed in three rows.

The fur-removing portion may have a length of approximately 3 to approximately 8 millimeters.

The fur-removing member may further include at least one inserting portion formed at the fur-removing body, and the nozzle body may include at least one hinge portion corresponding to the at least one inserting portion.

According to another aspect of the present disclosure, a suction nozzle for a vacuum cleaner may include a nozzle body to have a contaminants suction port formed on a bottom surface of the nozzle body; a front fur-removing member disposed in front of the contaminants suction port; and a rear fur-removing member disposed behind the contaminants suction port to face the front fur-removing member. Each of the front and rear fur-removing members may include a fur-removing body rotatably disposed at a side of the contaminants suction port on the nozzle body, a fur-removing portion formed in a plurality of pins vertically to the fur-removing body, and a plurality of rotation cams, wherein when the nozzle body moves in a first direction, the plurality of rotation cams forces the fur-removing body to rotate so that a leading end of the fur-removing portion is spaced apart from a surface to be cleaned.

The suction nozzle may include a rotation brush rotatably disposed in the contaminants suction port.

The suction nozzle may include a drive fan disposed at the nozzle body to be rotated by air drawn in via the contaminants suction port, wherein the drive fan rotates the rotation brush.

When the nozzle body moves in the first direction, the fur-removing portion of the front fur-removing member is inclined to the surface to be cleaned, and the fur-removing portion of the rear fur-removing member is vertical to the surface to be cleaned, and when the nozzle body moves in a second direction, the fur-removing portion of the front fur-removing member is vertical to the surface to be cleaned, and the fur-removing portion of the rear fur-removing member is inclined to the surface to be cleaned.

According to another aspect of the present disclosure, a suction nozzle for a vacuum cleaner may include a nozzle body to have a contaminants suction port formed on a bottom surface of the nozzle body; a front fur-removing member disposed in front of the contaminants suction port; and a rear fur-removing member disposed behind the contaminants suction port to face the front fur-removing member. Each of the front and rear fur-removing members may include a fur-removing body rotatably disposed at a side of the contaminants suction port on the nozzle body, a felt member disposed on a bottom surface of the fur-removing body, and a plurality of rotation cams, wherein when the nozzle body moves in a first direction, the plurality of rotation cams forces the fur-removing body to rotate so that the felt member is spaced apart from a surface to be cleaned.

Other objects, advantages and salient features of the preferred embodiments of the present disclosure will become apparent from the following detailed description, which, taken in conjunction with the annexed drawings, discloses the preferred embodiments of the present disclosure.

BRIEF DESCRIPTION OF THE DRAWINGS

These and/or other aspects and advantages of the present disclosure will become apparent and more readily appreciated from the following description of the embodiments, taken in conjunction with the accompanying drawings in which.

Throughout the drawings, like reference numerals will be understood to refer to like parts, components and structures.

DETAILED DESCRIPTION OF THE EXEMPLARY EMBODIMENTS

Hereinafter, certain exemplary embodiments of the present disclosure will be described in detail with reference to the accompanying drawings.

The matters defined in the description, such as a detailed construction and elements thereof, are provided to assist in a comprehensive understanding of the invention. Thus, it is apparent that the present disclosure may be carried out without those defined matters. Also, well-known functions or constructions are omitted to provide a clear and concise description of exemplary embodiments of the present disclosure.

Figure 1:
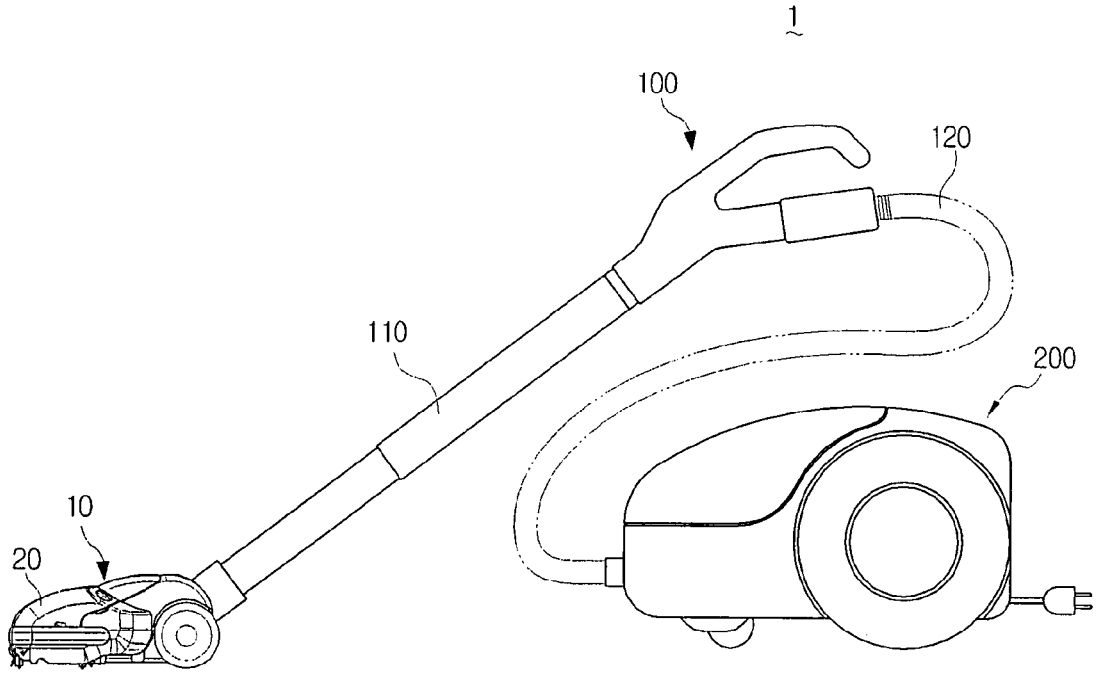
FIG. 1 is a side view illustrating a vacuum cleaner having a suction nozzle according to an exemplary embodiment of the present disclosure.
Figure 2:
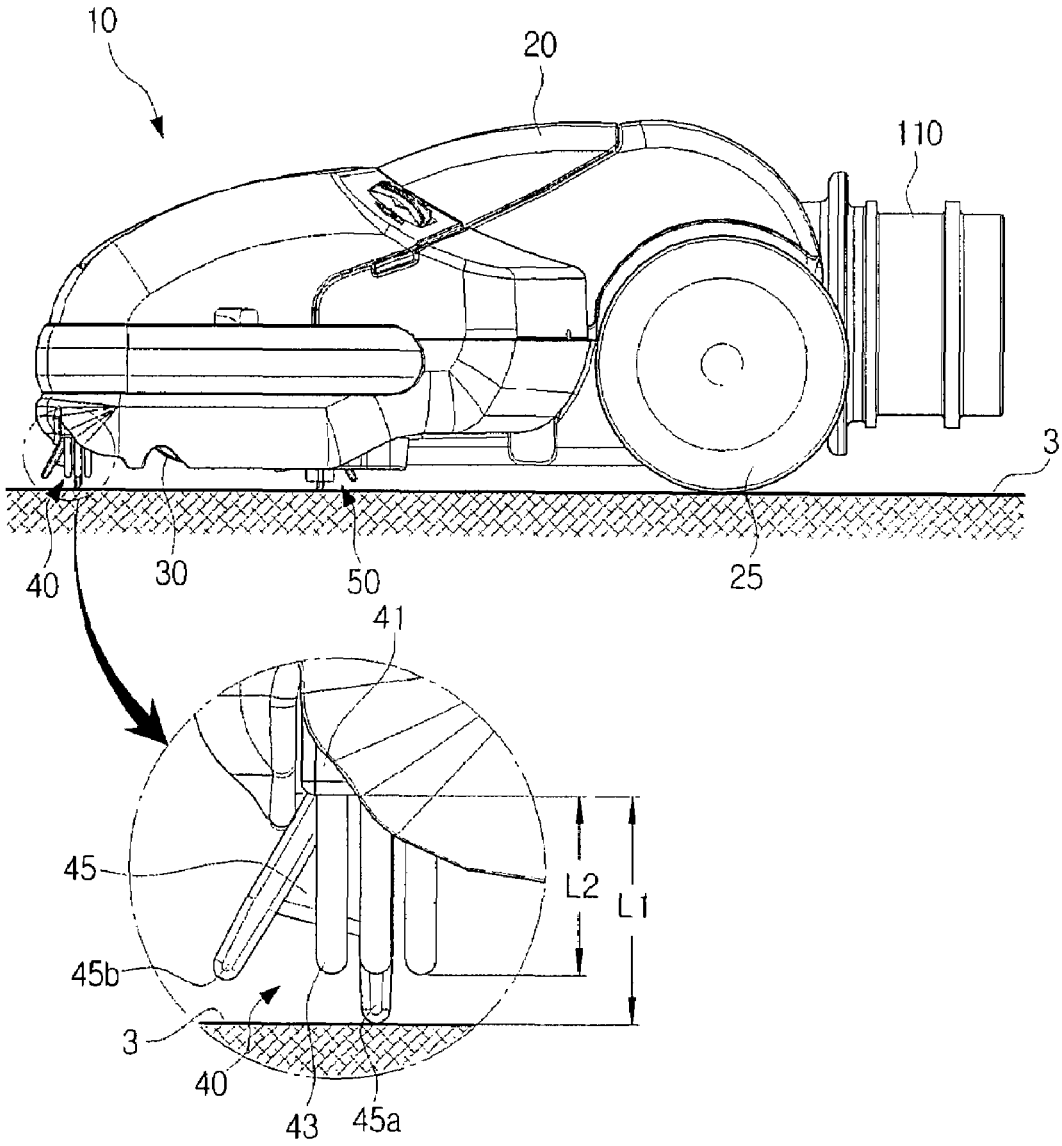
FIG. 2 is a side view illustrating the suction nozzle of the vacuum cleaner of FIG. 1.
Figure 3:
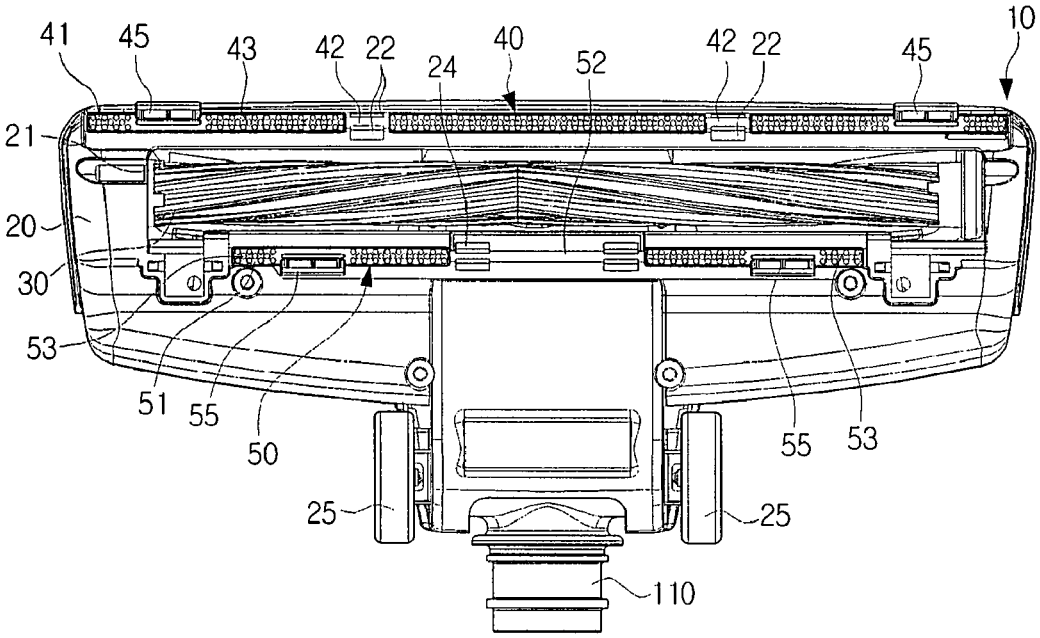
FIG. 3 is a bottom view illustrating the suction nozzle of the vacuum cleaner of FIG. 1 with a fur removing member.
Figure 4:
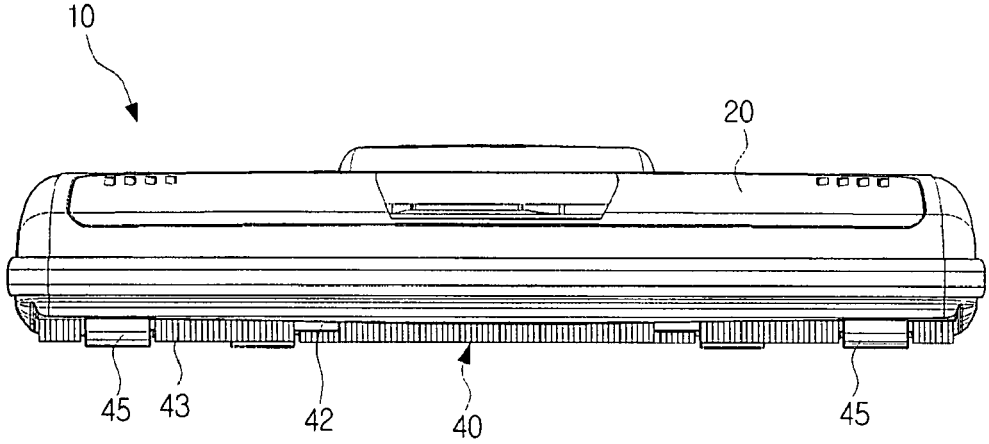
FIG. 4 is a front view illustrating the suction nozzle of the vacuum cleaner of FIG. 1 with a fur removing member.
Figure 5:
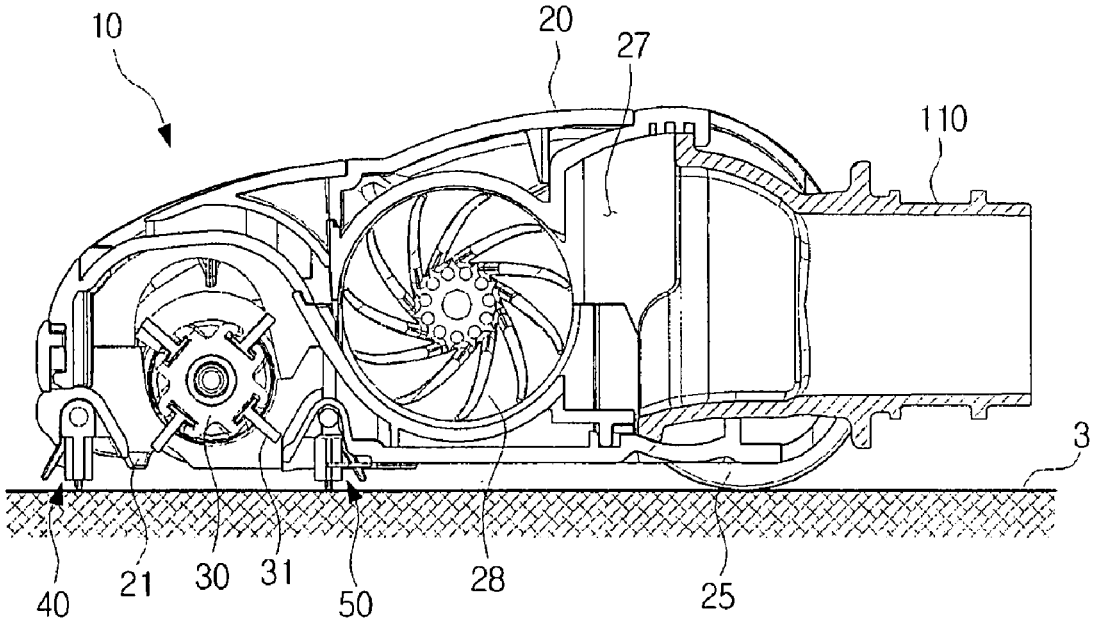
FIG. 5 is a sectional view illustrating the suction nozzle of the vacuum cleaner of FIG. 1 taken along a centerline thereof.

FIG. 1 is a side view illustrating a vacuum cleaner 1 having a suction nozzle 10 according to an exemplary embodiment of the present disclosure, and FIG. 2 is a side view illustrating the suction nozzle 10 of the vacuum cleaner 1 of FIG. 1. FIGS. 3 and 4 are a bottom view and a front view illustrating the suction nozzle 10 of the vacuum cleaner 1 of FIG. 1 with a fur removing member 40, respectively. FIG. 5 is a sectional view illustrating the suction nozzle 10 of the vacuum cleaner 1 of FIG. 1 taken along a centerline thereof.

Referring to FIGS. 2 to 5, the suction nozzle 10 for the vacuum cleaner 1 according to an exemplary embodiment of the present disclosure includes a nozzle body 20, a rotation brush 30, a front fur removing member 40, and a rear fur removing member 50.

The nozzle body 20 is connected with an extension pipe 110, and moves on a surface 3 to be cleaned to draw in contaminants from the surface 3 to be cleaned. On a bottom surface of the nozzle body 20 is formed a contaminants suction port 21 to draw in contaminants and air from the surface 3 to be cleaned. A contaminants suction passage 27 is formed inside the nozzle body 20. A drive fan 28 may be disposed in the contaminants suction passage 27 to be rotated by the drawn in contaminants and air. Also, a pair of wheels 25 is disposed on both sides of the nozzle body 20 so that the nozzle body 20 can move on the surface 3 to be cleaned. The nozzle body 20 is connected with the cleaner body 200 via the extension pipe 110 connected to a rear end of the nozzle body 20 (see FIG. 1). Therefore, the contaminants and air drawn in through the contaminants suction port 21 of the nozzle body 20 move to the cleaner body 200 via the contaminants suction passage 27 and the extension pipe 110.

The rotation brush 30 is rotatably disposed at the contaminants suction port 21 of the nozzle body 20. The rotation brush 30 has a plurality of bristles 31 that is formed on a surface of the rotation brush 30 to contact the surface 3 to be cleaned. Therefore, when the rotation brush 30 rotates, the plurality of bristles 31 rubs against the surface 3 to be cleaned, thereby easily removing contaminants from the surface 3 to be cleaned. In this exemplary embodiment, as illustrated in FIG. 5, the rotation brush 30 has the plurality of bristles 31 formed in four rows separated by 90 degrees interval.

Figure 9:
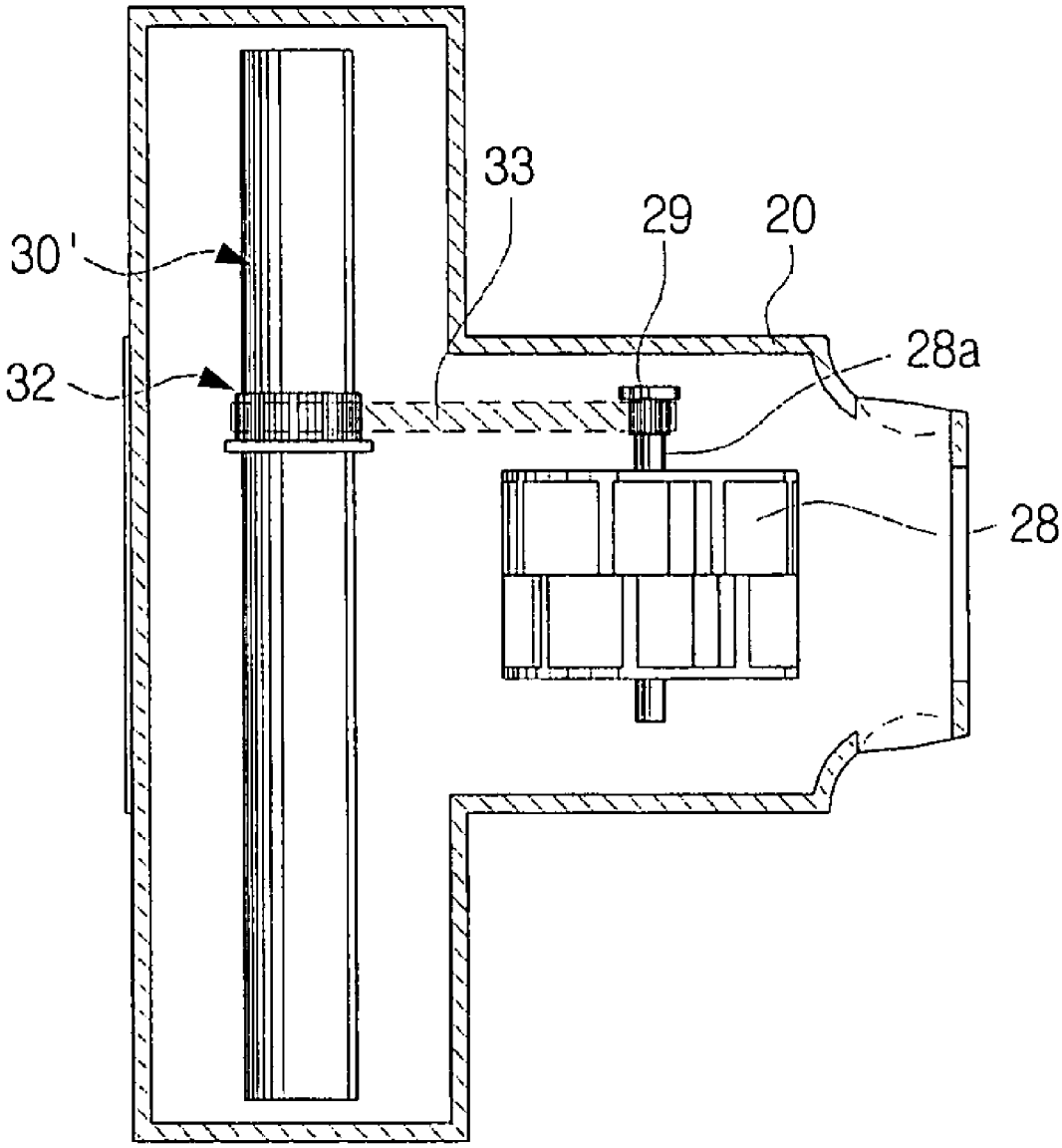
FIG. 9 is a conceptual view schematically illustrating a connection between a rotation brush and a drive fan of a suction nozzle for a vacuum cleaner according to an exemplary embodiment of the present disclosure.

The rotation brush 30 may be configured to rotate by a friction force between the bristles 31 and the surface 3 to be cleaned. Alternatively, the rotation brush 30 may be configured to rotate by the drive fan 28. FIG. 9 conceptually illustrates a structure in which the drive fan 28 rotates the rotation brush 30. Referring to FIG. 9, a driven pulley 32 is disposed coaxially with the rotation brush 30', and the drive pulley 29 is disposed on a rotation shaft 28*a* of the drive fan 28. The driven pulley 32 and the drive pulley 29 are connected by a belt 33. Therefore, the contaminants-laden air passes through the contaminants suction passage 27 to rotate the drive fan 28 disposed in the contaminants suction passage 27. When the drive fan 28 is rotated, the rotation brush 30' connected by the belt 33 is rotated.

Referring to FIG. 5, the front fur removing member 40 and the rear fur removing member 50 scrape off and collect human hair, or pet fur, from the surface 3 to be cleaned. The front fur removing member 40 and the rear fur removing member 50 have substantially the same structure. Hereinafter, the term "fur removing member" is used to refer to both the front and rear fur removing members 40 and 50, and a structure of the fur removing member will be explained. However, a view to illustrate the front fur removing member 40 will be referred to for convenience of explanation.

Figure 6:
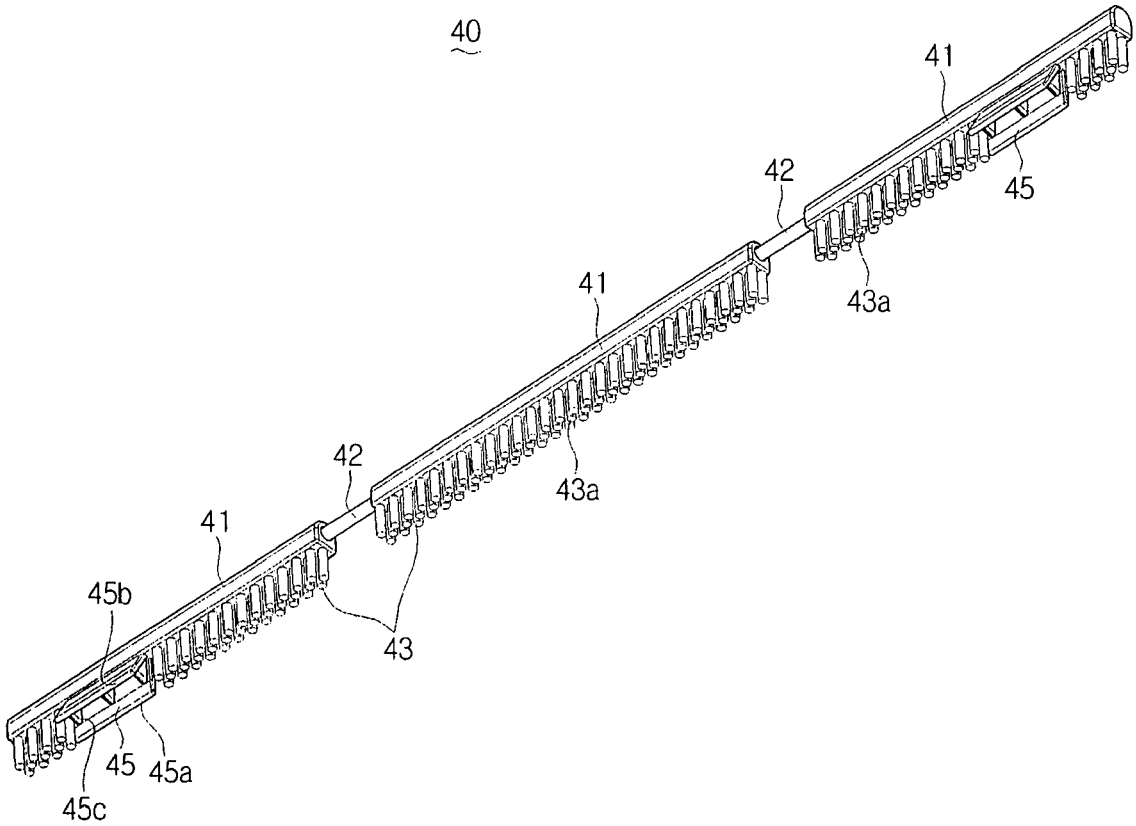
FIG. 6 is a bottom perspective view illustrating a fur removing member of the suction nozzle of the vacuum cleaner of FIG. 1.

Referring to FIG. 6, the fur-removing member 40 includes a fur-removing body 41, a fur-removing portion 43, and a plurality of rotation cams 45.

The fur-removing body 41 is rotatably disposed at one side of the contaminants suction port 21 on the bottom surface of the nozzle body 20, as shown in FIG. 2. The nozzle body 20 is provided with at least one hinge portion 22 as illustrated in FIG. 3, and the fur-removing body 41 is provided with at least one inserting portion 42 to be inserted into the hinge portion 22 so that the fur-removing body 41 can rotate with respect to the nozzle body 20. The hinge portion 22 of the nozzle body 20 is formed as two pieces that face each other and are fabricated from an elastic material. Therefore, the fur-removing body 41 may be easily mounted by a user onto nozzle body 20 by pushing the inserting portion 42 on an entrance of the hinge portion 22.

The fur-removing portion 43 is disposed beneath the fur-removing body 41, and may have a plurality of pins 43*a* substantially perpendicularly disposed along a bottom surface of the fur-removing body 41. The fur-removing portion 43 may be formed of a soft material, e.g. rubber or urethane, to reduce abrasion caused by rubbing against the surface 3 to be cleaned. A length L2 (see FIG. 2) of the fur-removing portion 43 is approximately 3 millimeters to approximately 8 millimeters, so that the fur-removing portion 43 can effectively scrape off and collect long thin contaminants from a surface 3 to be cleaned. The fur-removing portion 43 may also be formed so that the plurality of pins 43*a* are arranged in a plurality of rows on the bottom surface of the fur-removing body 41. In the exemplary embodiment illustrated in FIG. 6, the fur-removing portion 43 has the plurality of pins 43*a* formed in three rows.

The plurality of rotation cams 45 is disposed under the fur-removing body 41. When the nozzle body 20 moves in a first direction, the plurality of rotation cams 45 causes the fur-removing body 41 to rotate by a predetermined angle so that a leading end of the fur-removing portion 43 is spaced apart from the surface 3 to be cleaned. The rotation cam 45 is formed substantially in a fan shape, and is disposed on the bottom surface of the fur-removing body 41 so that a first side surface 45*a* of the rotation cam 45 is parallel to the plurality of pins 43*a* of the fur-removing portion 43. A second side surface 45*b* of the rotation cam 45 is formed to space by a predetermined angle apart from the first side surface 45*a*. The first and second side surfaces 45*a* and 45*b* of the rotation cam 45 may be supported by a plurality of supporting ribs 45*c*. Therefore, the rotation cam 45 projects from a side of the fur-removing portion 43 as illustrated in FIGS. 2 and 6. The rotation cam 45 is disposed so that either of leading ends of the first and second side surfaces 45*a* and 45*b* contacts the surface 3 to be cleaned. As a result, when the suction nozzle 10 moves, either of the first and second side surfaces 45*a* and 45*b* of the rotation cam 45 of the fur-removing member 40 rubs against the surface 3 to be cleaned to allow the fur-removing member 40 to rotate.

The first and second side surfaces 45*a* and 45*b* of the rotation cam 45 have substantially the same length. The rotation cam 45 is formed so that a length L1 of the first side surface 45*a* from the bottom surface of the fur-removing body 41 to the leading end of the first side surface 45*a* is longer than the length L2 of the fur-removing portion 43 as illustrated in FIG. 2. As shown in FIG. 2, the leading end of the fur-removing portion 43 does not contact the surface 3 to be cleaned. When the nozzle body 20 moves in a first direction, the first side surface 45*a* of the rotation cam 45 is rotated by the friction force against the surface 3 to be cleaned so that the second side surface 45*b* of the rotation cam 45 contacts the surface 3 to be cleaned. As a result, the rotation cam 45 causes the fur-removing member 40 to rotate on the inserting portion 42 of the fur-removing body 41 by a predetermined angle. The fur-removing member 40 may have at least two rotation cams 45. In this exemplary embodiment, two rotation cams 45 are disposed near both ends of the fur-removing member 40.

Figure 10:
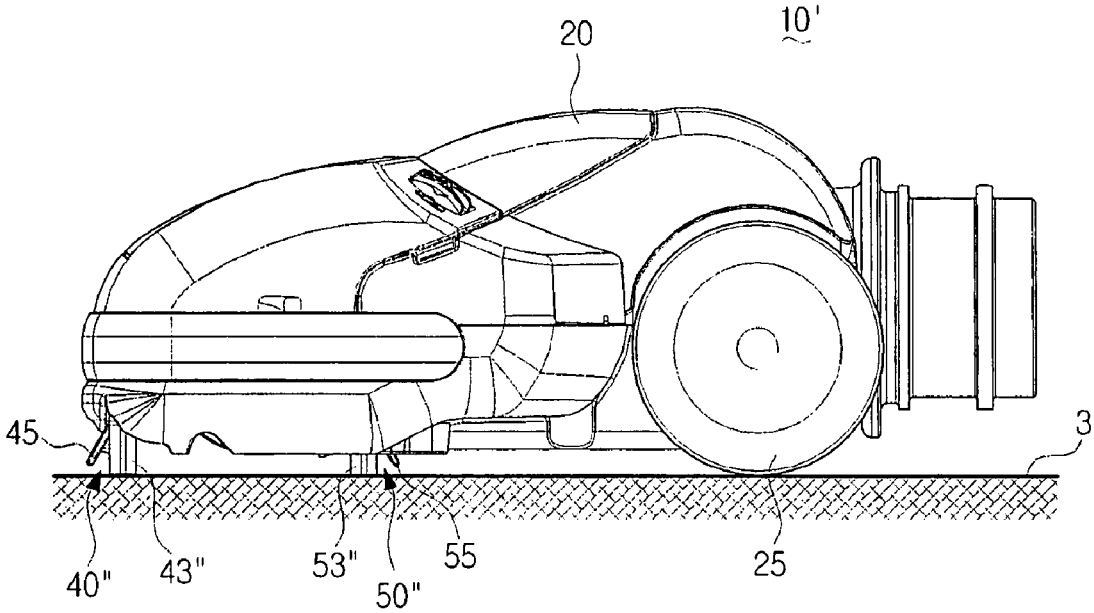
FIG. 10 is a side view illustrating a suction nozzle for a vacuum cleaner according to an exemplary embodiment of the present disclosure having another fur removing member.

In the above explanation, the length L1 of the first side surface 45*a* of the rotation cam 45 is longer than the length L2 of the fur-removing portion 43; however, this is only one example and not intended to be limiting. Alternatively, the first side surface 45*a* of the rotation cam 45 may be formed to have the same length as that of the fur-removing portion 43", as illustrated in FIG. 10. In this case, leading ends of fur-removing portions 43" and 45" of the front and rear fur-removing members 40" and 50" contact the surface 3 to be cleaned.

Referring to FIG. 3, the fur-removing body 41 and 51, the fur-removing portion 43 and 53, and the rotation cams 45 and 55 may be molded in one single body using a single material, thereby forming the fur-removing member 40 and 50. Alternatively, the fur-removing member 40 and 50 may be formed using two kinds of materials for easy manufacturing and maximizing a function of the fur-removing member 40 and 50.

Figure 7:
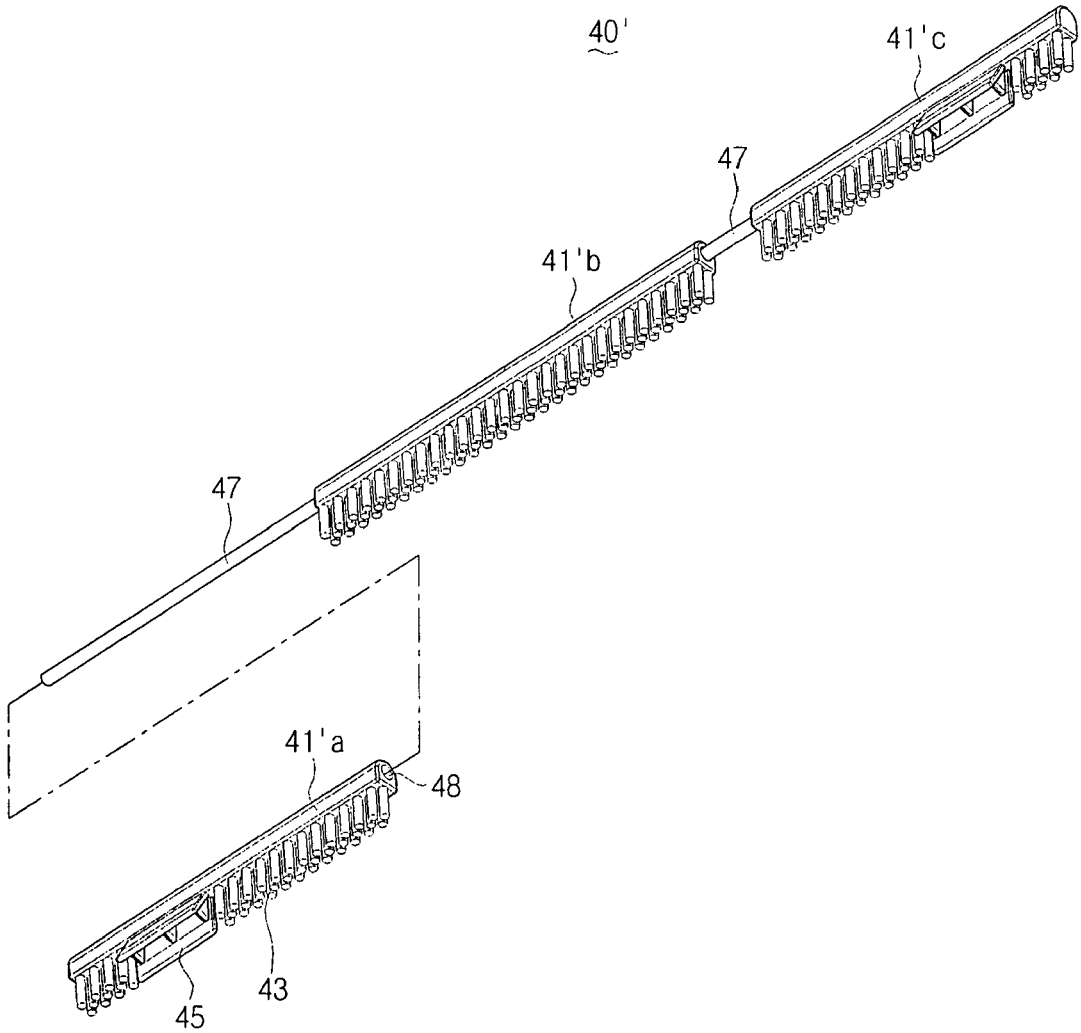
FIG. 7 is a bottom exploded perspective view illustrating a fur removing member of the suction nozzle of the vacuum cleaner of FIG. 1.

FIG. 7 illustrates a front fur-removing member 40' as one example of the fur-removing member formed of two kinds of materials. Referring to FIG. 7, the front fur-removing member 40' has three fur-removing bodies 41'*a*, 41'*b*, and 41'*c*. Each of the three fur-removing bodies 41'*a*, 41'*b*, and 41'*c* has a through hole 48 formed in a lengthwise direction thereof. A rotation shaft 47 is inserted in the through holes 48 of the fur-removing bodies 41'*a*, 41'*b*, and 41'*c* so that the three fur-removing bodies 41'*a*, 41'*b*, and 41'*c* are connected to form one fur-removing member 40'. Portions of the rotation shaft 47 that are exposed between the three fur-removing bodies 41'*a*, 41'*b*, and 41'*c* serve as the inserting portion 42 of the fur-removing member 40 as described above. The rotation shaft 47 may be formed of a material having a higher rigidity than that of the fur-removing bodies 41'*a*, 41'*b*, and 41'*c*. For example, the rotation shaft 47 may be formed of a ferrous metal. The fur-removing portion 43 and the rotation cam 45 formed in each of the three fur-removing bodies 41'*a*, 41'*b*, and 41'*c* may be formed, e.g. by molding, of the same material as that of the fur-removing bodies 41'*a*, 41'*b*, and 41'*c*.

Referring to FIG. 3, the front fur-removing member 40 according to an embodiment of the present disclosure is disposed in front of the rotation brush 30 (top of FIG. 3), and has two inserting portions 42 formed in the fur-removing body 41 and two rotation cams 45 formed to face a side opposite to the rotation brush 30. The rear fur-removing member 50 is disposed behind the rotation brush 30 (bottom of FIG. 3), and has one inserting portion 52 formed in the fur-removing body 51 and two rotation cams 55 formed to face a side opposite to the rotation brush 30.

Referring to FIG. 1, the suction nozzle 10 is in fluid communication with the cleaner body 200 via the extension pipe assembly 100. The extension pipe assembly 100 includes the extension pipe 110 connected to the suction nozzle 10, and a flexible hose 120 to connect the extension pipe 110 and the cleaner body 200.

The cleaner body 200 is provided with a contaminants collecting apparatus (not illustrated) to separate and collect contaminants drawn in via the suction nozzle 10, and a vacuum generator (not illustrated) to generate a suction force for drawing in the contaminants.

Hereinafter, operation of the suction nozzle 10 for the vacuum cleaner 1 having the above-described structure will be explained with reference to FIGS. 1, 2, 8A and 8B.

When the vacuum cleaner 1 is turned on, the vacuum generator in the cleaner body 200 operates to generate a suction force. The suction force is applied to the contaminants suction port 21 of the suction nozzle 10 to draw in contaminants from the surface 3 to be cleaned via the contaminants suction port 21. The suction nozzle 10 for the vacuum cleaner 1 according to an embodiment of the present disclosure provides the front and rear fur-removing members 40 and 50 that facilitate removal of long thin contaminants from the surface 3 to be cleaned.

Operation of the front and rear fur-removing members 40 and 50, hereinafter, will be explained in detail with reference to FIGS. 2, 8A and 8B.

When the suction nozzle 10 is put on the surface 3 to be cleaned, the fur-removing portions 43 and 53 of the front and rear fur-removing members 40 and 50 are vertical to the surface 3 to be cleaned as illustrated in FIG. 2.

Figure 8A:
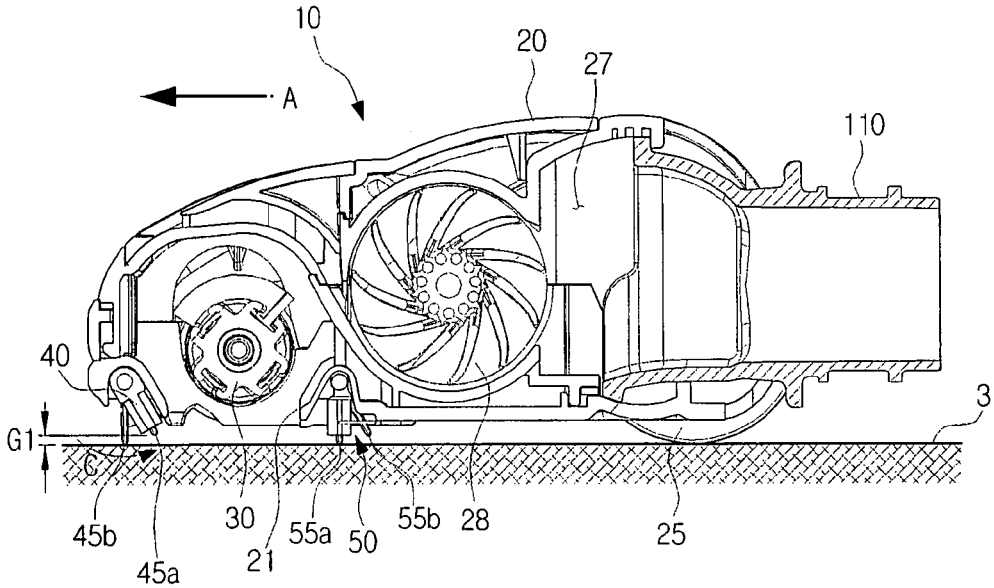
FIGS. 8A and 8B are a sectional view illustrating operations of front and rear fur removing member according to a moving direction of a suction nozzle for a vacuum cleaner according to an exemplary embodiment of the present disclosure, respectively.

In this state, when the suction nozzle 10 is pushed in a first direction A illustrated in FIG. 8A, the front fur-removing member 40 is rotated in a counterclockwise direction C by the friction force of the plurality of rotation cams 45 against the surface 3 to be cleaned. When the front fur-removing member 40 rotates in the counterclockwise direction C, a front gap G1 is formed between the surface 3 to be cleaned and the leading end of the front fur-removing member 40, as illustrated in FIG. 8A, so that contaminants on the surface 3 to be cleaned in front of the front fur-removing member 40 can easily be moved toward the contaminants suction port 21. At this time, the rear fur-removing member 50 remains substantially perpendicular to the surface 3 to be cleaned. Therefore, the rear fur-removing member 50 can scrape off and collect long thin contaminants such as hair of humans or/and fur of pets, which the rotation brush 30 disposed in the contaminants suction port 21 cannot remove from the surface 3 to be cleaned. Even when cleaning the surface 3 to be cleaned such as a carpet having a plurality of furs thereon, from which long thin contaminants are hard to be removed due to the plurality of fur thereof, the plurality of pins of the fur-removing portion 53 of the rear fur-removing member 50 can be inserted into the fur of the carpet so that the rear fur-removing member 50 can easily scrape off and collect the long thin contaminants. The long thin contaminants scraped off and collected by the rear fur-removing member 50 are drawn into the contaminants suction port 21.

Figure 8B:
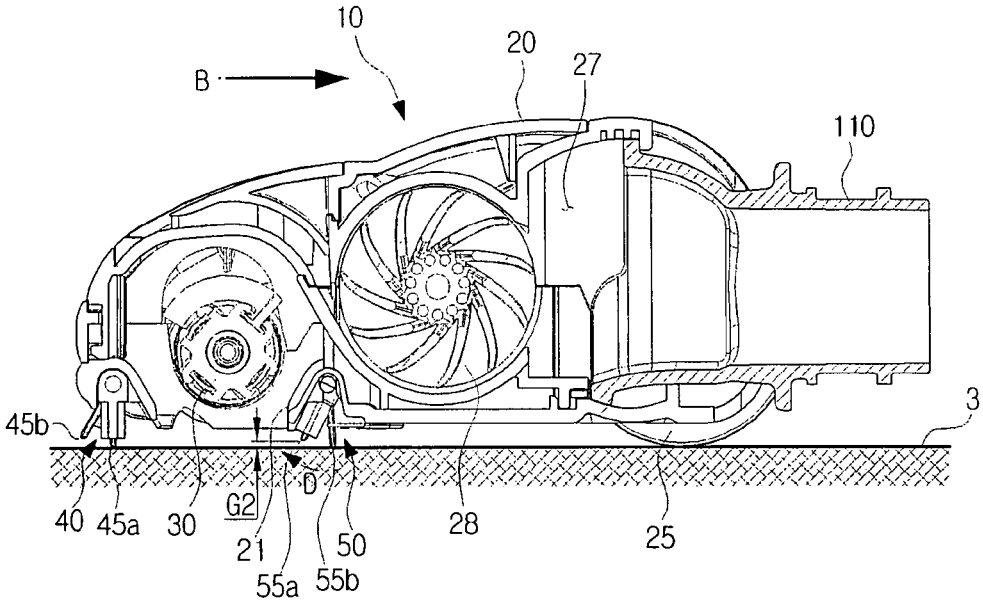

Referring to FIG. 8B, when a user pulls the suction nozzle 10 in a second direction B opposite to the first direction, the front fur-removing member 40 is rotated in a clockwise direction by the friction force of the plurality of rotation cams 45 against the surface 3 to be cleaned, and then assumes an orientation substantially perpendicular to the surface 3 to be cleaned, as illustrated in FIG. 8B. Therefore, the front fur-removing member 40 can scrape off and collect long thin contaminants, which the rotation brush 30 disposed in the contaminants suction port 21 cannot remove from the surface 3 to be cleaned. Even when cleaning the surface 3 to be cleaned such as the carpet having a plurality of fur thereon, from which long thin contaminants are hard to be removed due to the plurality of fur thereof, the front fur-removing member 40 can easily remove the long thin contaminants as the same as the above-described rear fur-removing member 50. When a user pulls nozzle 10 in direction B, the rear fur-removing member 50 is rotated in the clockwise direction D by the friction force of the plurality of rotation cams 55 against the surface 3 to be cleaned. When the rear fur-removing member 50 rotates in the clockwise direction, a rear gap G2 is formed between the surface 3 to be cleaned and the leading end of the rear fur-removing member 50, as illustrated in FIG. 8B, so that contaminants on the surface 3 to be cleaned behind the rear fur-removing member 50 can easily be moved toward the contaminants suction port 21.

The long thin contaminants removed from the surface 3 to be cleaned by the front and rear fur-removing members 40 and 50 are drawn into the contaminants suction port 21 of the suction nozzle 10 with air. The contaminants drawn in the contaminants suction port 21 move to the cleaner body 200 via the contaminants suction passage 27 of the suction nozzle 10, along with air, and the extension pipe 110 and the flexible hose 120 of the extension pipe assembly 100 (see FIG. 1). When the contaminants enters the contaminants collecting apparatus in the cleaner body 200, the contaminants collecting apparatus separates contaminants from air, and then discharges cleaned air outside the cleaner body 200.

Figure 11:
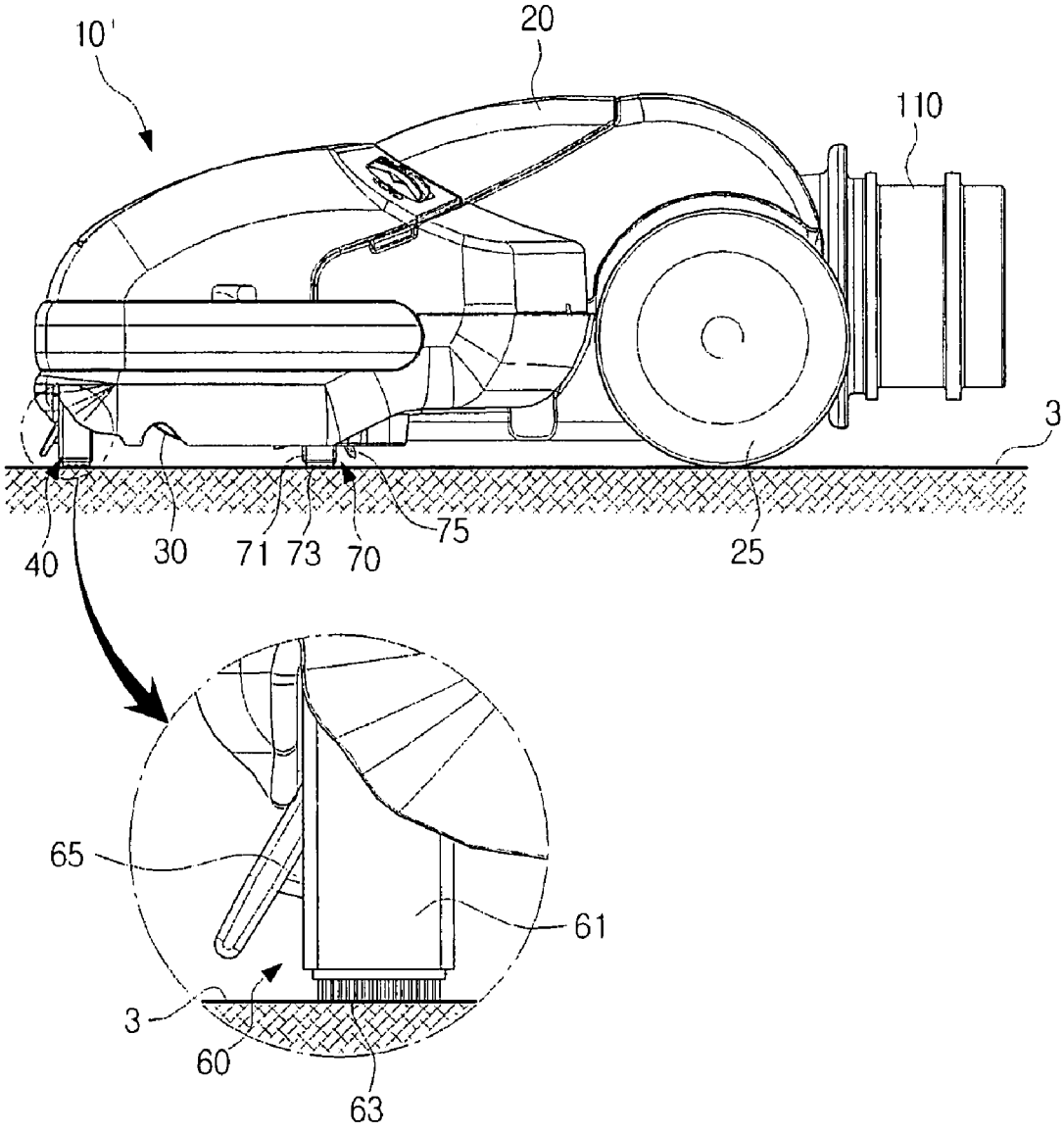
FIG. 11 is a side view illustrating a suction nozzle for a vacuum cleaner according to an exemplary embodiment of the present disclosure having another fur removing member.

FIG. 11 is a side view illustrating a suction nozzle 10' for the vacuum cleaner 1 according to another exemplary embodiment of the present disclosure.

Referring to FIG. 11, the suction nozzle 10' for the vacuum cleaner 1 according to another embodiment of the present disclosure includes a nozzle body 20, a rotation brush 30, a front fur removing member 60, and a rear fur removing member 70.

The suction nozzle 10' according to this exemplary embodiment has the same nozzle body 20 and rotation brush 30 as those of the suction nozzle 10 according to the above-described embodiment, and the front and rear fur-removing members 60 and 70 different from those of the above-described suction nozzle 10. Therefore, only the front and rear fur-removing members 60 and 70 will be explained, hereinafter.

The front fur-removing member 60 includes a fur-removing body 61, a fur-removing portion 63, and a plurality of rotation cams 65. In this exemplary embodiment, the fur-removing portion 63 is made of felt unlike the above-described embodiment. That is, the fur-removing portion 63 is formed of a felt member. The fur-removing body 61 and the plurality of rotation cams 65 are molded in one single body, and the felt member 63 is attached on a bottom surface of the fur-removing body 61, thereby forming the front fur-removing member 60. The rear fur-removing member 70 may be formed as the substantially same structure as that of the front fur-removing member 60.

In other words, the front and rear fur-removing members 60 and 70 are substantially the same as the front and rear fur-removing members 40 and 50 of the suction nozzle 10 according to an embodiment as described above except that the fur-removing portions 63 and 73 are formed of the felt instead of the plurality of pins made of a rubber or urethane.

With the suction nozzle for the vacuum cleaner according to an embodiment of the present disclosure, the front and rear fur-removing members can scrape off and collect the long thin contaminants such as human hair, or pet fur, so that the suction nozzle can effectively separate and draw in the long thin contaminants.

Because of the pinlike structures of the fur-removing portions 43 and 53 the front and rear fur-removing members can be inserted into fur of the carpet, thus enabling the suction nozzle 10 for the vacuum cleaner 1 according to an embodiment of the present disclosure effectively to remove long thin contaminants from a surface to be cleaned with a lot of fur thereon.

Also, with the suction nozzle 10 for the vacuum cleaner 1 according to an embodiment of the present disclosure, the front (40 and 60) and rear (50 and 70) fur-removing members can be separated from or mounted on the nozzle body 20 using the inserting portions 42 of the front (40 and 60) and rear (50 and 70) fur-removing members and the hinge portions 22 of the nozzle body 20 so that it is easy to use the suction nozzle 10 for the vacuum cleaner 1.

While the embodiments of the present disclosure have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the invention.

What is claimed is:

1. A suction nozzle for a vacuum cleaner comprising:

a nozzle body having a contaminants suction port formed on a bottom surface thereof;

and a fur-removing member having a fur-removing body rotatably disposed at a side of the contaminants suction port on the nozzle body, a fur-removing portion formed in a plurality of pins vertically to the fur-removing body, and a plurality of rotation cams, wherein when the nozzle body moves in a first direction, the plurality of rotation cams forces the fur-removing body to rotate so that a leading end of the fur-removing portion is spaced apart from a surface to be cleaned, wherein the plurality of rotation cams are formed substantially in a fan shape, and a side surface of each of the plurality of rotation cams is disposed on the fur-removing body substantially parallel to the plurality of pins of the fur-removing portion.

2. The suction nozzle of claim 1, wherein each of the plurality of rotation cams have a length from a bottom surface of the fur-removing body to a leading end of each of the plurality of rotation cams that is longer than a length of the fur-removing portion from the bottom surface of the fur-removing body to a leading end of the fur-removing portion.

3. The suction nozzle of claim 1, wherein the fur-removing portion comprises a plurality of pins formed in three rows.

4. The suction nozzle of claim 1, wherein the fur-removing portion has a length of approximately 3 to approximately 8 millimeters.

5. The suction nozzle of claim 1, wherein the fur-removing member further comprises at least one inserting portion formed at the fur-removing body, and the nozzle body comprises at least one hinge portion corresponding to the at least one inserting portion.

6. A suction nozzle for a vacuum cleaner comprising:

a nozzle body having a contaminants suction port formed on a bottom surface thereof;

a front fur-removing member disposed in front of the contaminants suction port; and a rear fur-removing member disposed behind the contaminants suction port to face the front fur-removing member, wherein each of the front and rear fur-removing members comprises:

a fur-removing body rotatably disposed at a side of the contaminants suction port on the nozzle body, a fur-removing portion formed in a plurality of pins vertically to the fur-removing body, and a plurality of rotation cams, wherein when the nozzle body moves in a first direction, the plurality of rotation cams forces the fur-removing body to rotate so that a leading end of the fur-removing portion is spaced apart from a surface to be cleaned, wherein the plurality of rotation cams are formed substantially in a fan shape, and a side surface of each of the plurality of rotation cams is disposed on the fur-removing body substantially parallel to the plurality of pins of the fur-removing portion.

7. The suction nozzle of claim 6, wherein each of the plurality of rotation cams have a length from a bottom surface of the fur-removing body to a leading end of each of the plurality of rotation cams that is longer than a length of the fur-removing portion from the bottom surface of the fur-removing body to the leading end of the fur-removing portion.

8. The suction nozzle of claim 6, wherein the fur-removing portion comprises a plurality of pins formed in three rows.

9. The suction nozzle of claim 6, further comprising:

a rotation brush rotatably disposed in the contaminants suction port.

10. The suction nozzle of claim 9, further comprising a drive fan disposed at the nozzle body to be rotated by air drawn in via the contaminants suction port, wherein the drive fan rotates the rotation brush.

11. The suction nozzle of claim 6, wherein when the nozzle body moves in the first direction, the fur-removing portion of the front fur-removing member is inclined to the surface to be cleaned, and the fur-removing portion of the rear fur-removing member is vertical to the surface to be cleaned, and wherein when the nozzle body moves in a second direction, the fur-removing portion of the front fur-removing member is vertical to the surface to be cleaned, and the fur-removing portion of the rear fur-removing member is inclined to the surface to be cleaned.

12. A suction nozzle for a vacuum cleaner comprising:

a nozzle body having a contaminants suction port formed on a bottom surface thereof;

a front fur-removing member disposed in front of the contaminants suction port; and a rear fur-removing member disposed behind the contaminants suction port to face the front fur-removing member; wherein each of the front and rear fur-removing members comprises;

a fur-removing body rotatably disposed at a side of the contaminants suction port on the nozzle body;

a felt member disposed on a bottom surface of the fur-removing body; and a plurality of rotation cams, wherein when the nozzle body moves in a first direction, the plurality of rotation cams forces the fur-removing body to rotate so that the felt member is spaced apart from a surface to be cleaned.

13. The suction nozzle of claim 1, wherein the fur-removing portion comprises a plurality of pins arranged in a row.

14. The suction nozzle of claim 6, wherein the fur-removing portion comprises a plurality of pins arranged in a row.

* * * * *